US005212931A

United States Patent [19]

Hartmann

[11] Patent Number: 5,212,931

[45] Date of Patent: May 25, 1993

[54] METHOD OF FILLING PASTE TUBES AND APPARATUS THEREFOR

[76] Inventor: Heinz Hartmann, Birnenweg 10, D-7417 Pfullingen, Fed. Rep. of Germany

[21] Appl. No.: 855,455

[22] Filed: Mar. 19, 1992

Related U.S. Application Data

[63] Continuation of Ser. No. 570,949, Aug. 22, 1990, abandoned.

[30] Foreign Application Priority Data

Aug. 24, 1989 [DE] Fed. Rep. of Germany ..... 3927996

[51] Int. Cl.[5] ..... B65B 3/04; B65B 11/58

[52] U.S. Cl. ..... 53/449; 53/469; 53/473; 141/10; 141/114; 141/390

[58] Field of Search ..... 53/173, 175, 242, 243, 53/255, 258, 260, 390, 392, 449, 469, 473, 567, 576; 141/2, 10, 18, 59, 67, 114, 314, 390

[56] References Cited

U.S. PATENT DOCUMENTS

| | | | |
|---|---|---|---|
| 1,446,047 | 2/1923 | Keller et al. . | |
| 1,828,865 | 10/1931 | Hopkins | 53/175 |
| 2,381,454 | 8/1945 | Huth | 141/59 |
| 2,503,171 | 4/1950 | Posner | 53/471 X |
| 2,864,213 | 12/1958 | Carter | 53/567 X |
| 3,562,998 | 2/1971 | Edwards | 53/473 X |
| 3,824,760 | 7/1974 | Sinichenko et al. | 53/243 X |
| 4,161,970 | 7/1979 | Lamb . | |
| 4,658,989 | 4/1987 | Bonerb | 53/175 X |

FOREIGN PATENT DOCUMENTS

| | | | |
|---|---|---|---|
| 252905 | 4/1911 | Fed. Rep. of Germany . | |
| 2908703 | 10/1980 | Fed. Rep. of Germany . | |
| 3733687 | 4/1988 | Fed. Rep. of Germany | 141/114 |

*Primary Examiner*—John Sipos
*Assistant Examiner*—Linda B. Johnson
*Attorney, Agent, or Firm*—Andrus, Sceales, Starke & Sawall

[57] ABSTRACT

In a method or filling paste tubes and apparatus therefor, the ointment is filled into a plastic skirt designed for once-only use and then introduced into the tube by means of this plastic skirt. During the filling of the ointment into the tube, a part of the plastic skirt not moistened by the ointment is made to cover the inner parts of the bottom end of the tube, so that these parts are protected against being moistened by the ointment. The method and apparatus may be used for the manual filling of tubes with a pasty mass, especially when making up prescriptions.

12 Claims, 7 Drawing Sheets

Figure 1A:
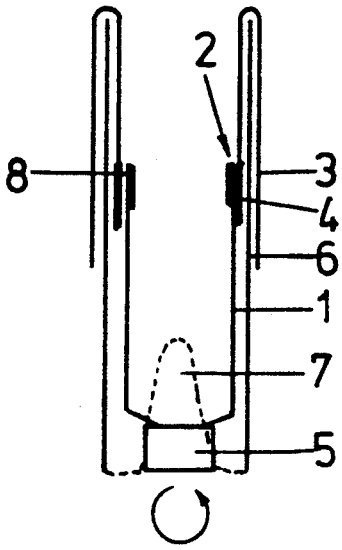

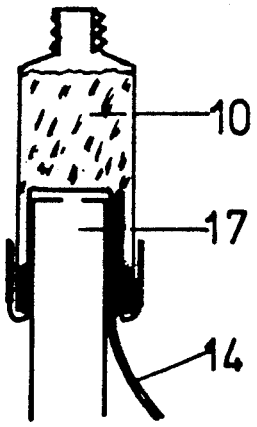
FIG. 1f
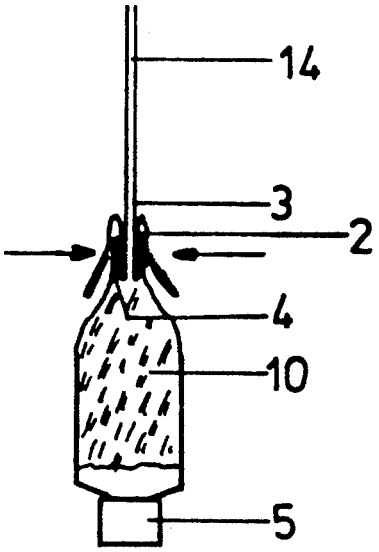
FIG. 1g
FIG. 4
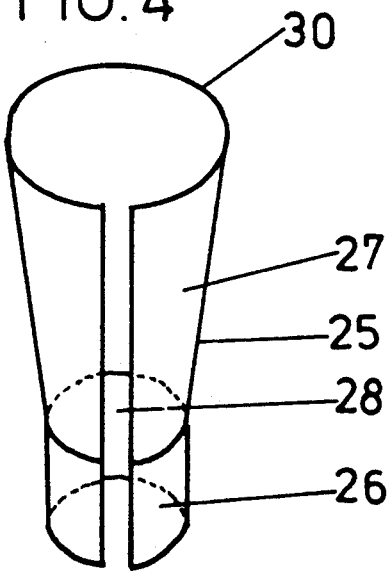
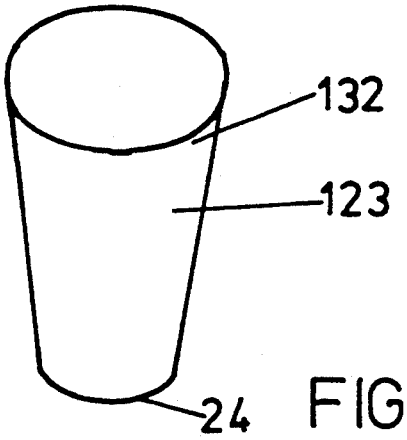
FIG. 3b
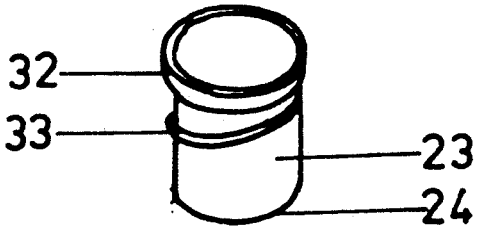
FIG. 3a
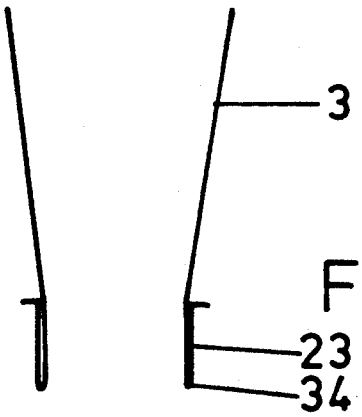
FIG. 3c

METHOD OF FILLING PASTE TUBES AND APPARATUS THEREFOR

This application is a continuation of Ser. No. 07/570,949, filed Aug. 22, 1990, now abandoned.

DESCRIPTION

The present invention concerns a method of filling a collapsible paste tube.

Small quantities of ready-to-use ointments or similar pasty masses can be filled either into small ointment pots or into tubes. While a pot can be filled very simply by means of a spatula, tubes call for the use of special filling apparatus or devices that generally have to be cleaned after the filling and are sometimes also difficult to operate; furthermore, these devices generally also give rise to a considerable residue of ointment that cannot be introduced into the tube by means of the device itself.

The use of ointment pots, on the other hand, creates hygienic problems that greatly reduce the useful life of the ointment. The fact that the ointment is customarily removed by means of a finger readily permits the introduction of dirt or germs and therefore leads to faster deterioration of the ointment. This is particularly true in the case of creams, which—given their high water content—constitute an ideal nutritive substrate.

Considerable improvement in the filling of tubes was brought by the device according to DE-PS 29 08 703. There a thin plastic skirt, intended to be used only once, is pulled over the tube from the side of the screw cap and right through to the as yet open bottom end of the tube. This skirt is filled with the pasty mass, which is then conveyed into the tube by squeezing the skirt. This arrangement made it possible for the first time to introduce an ointment or other pasty masses into a tube by means that were almost wholly manual without there being any need for subsequent cleansing operations. A drawback was however constituted by the fact that the inner end of the tube becomes moistened with ointment, so that tubes with a socalled latex ring could not be used to advantage. This latex ring is a coating of latex material—width about 1.5 cm—applied on the inner wall of the as yet open end of the tube and serves the purpose of making possible an additional adhesive seal when the walls are pressed together during closure of the tube. But this does not prove possible when the latex ring has been previously rendered greasy by the ointment or pasty mass during filling.

The present invention is underlain by the problem of making available a method by means of which tubes can be filled in a simple manner, and where cleaning operations will either be unnecessary or of only very slight extent. Moreover, the ointment or pasty mass is to be capable of being introduced into the tube almost without losses, and it should be possible to perform all work especially by hand and without the need for a great deal of material. The method should also make it possible for the tube to be filled in such a manner that the inside of the end of the tube to be closed will not be moistened by the ointment.

It is also a task of the invention to provide apparatus suitable for carrying out this method.

This problem is solved by an appropriate method having the characterizing features of the present invention.

It has been found that when the plastic skirt is brought through the as yet open bottom end of the tube and over the inner wall thereof, the filling material (pasty mass) can be conveyed into the tube very simply and without wetting the inner end of the tube. Depending on the particular design of the plastic skirt, apparatus and devices of various kinds can be used for filling the tube, the said devices being not only economic in manufacture, but also such as not to come into contact with the ointment, so that no cleaning operations are needed.

Further advantages and different embodiments of the method, as well as corresponding devices, are illustrated in the drawings and will be described in greater detail hereinbelow.

The drawings are as follows:

FIGS. 1*a*–1*g* show an arrangement for filling a tube with a plastic skirt applied to the outside of the end of the tube, the arrangement being shown in longitudinal section and in various phases of the filling process.

FIGS. 2*a*–2*g* show a longitudinal section through an arrangement for filling a tube with a plastic skirt kept in the interior of the tube by means of a piece of tubing, the arrangement being shown in various phases of the filling process FIGS. 3*a*–3*c* shows—partly in perspective view (FIGS. 3*a* and 3*b*) and partly in longitudinal section (FIG. 3*c*)—various embodiments of the piece of tubing for keeping the plastic skirt in position as in FIG. 2

FIG. 4 shows a perspective view of a funnel serving as filling device

Figure 5C:
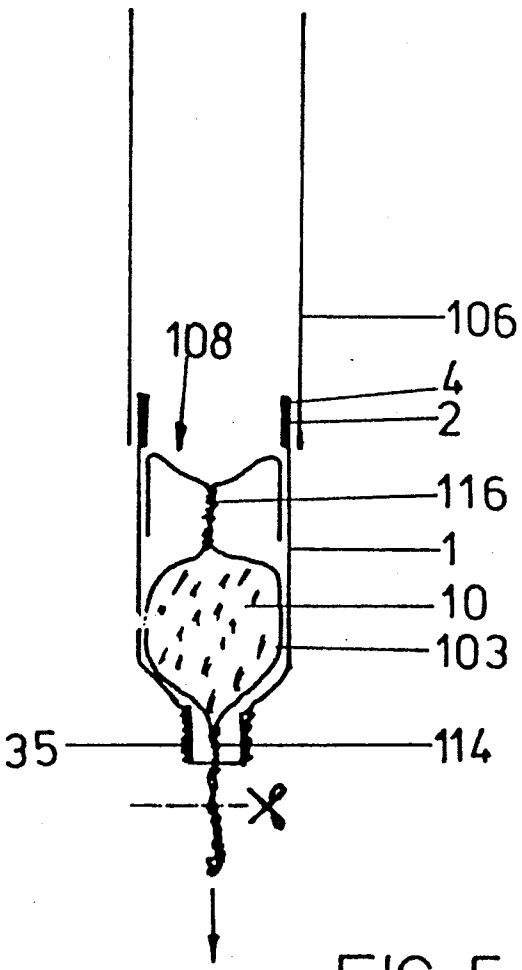
Figure 5B:
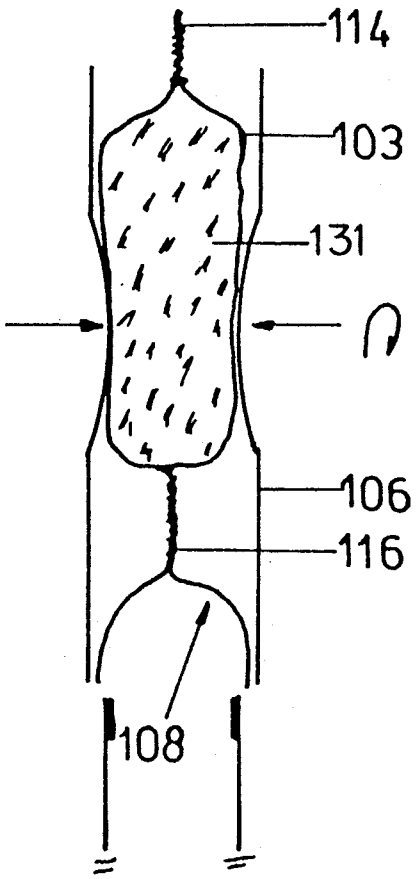
Figure 5A:
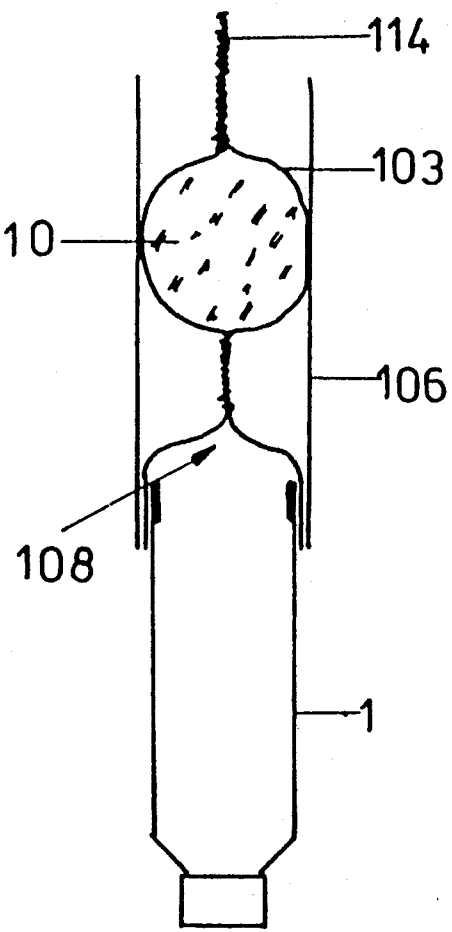
Figure 6C:
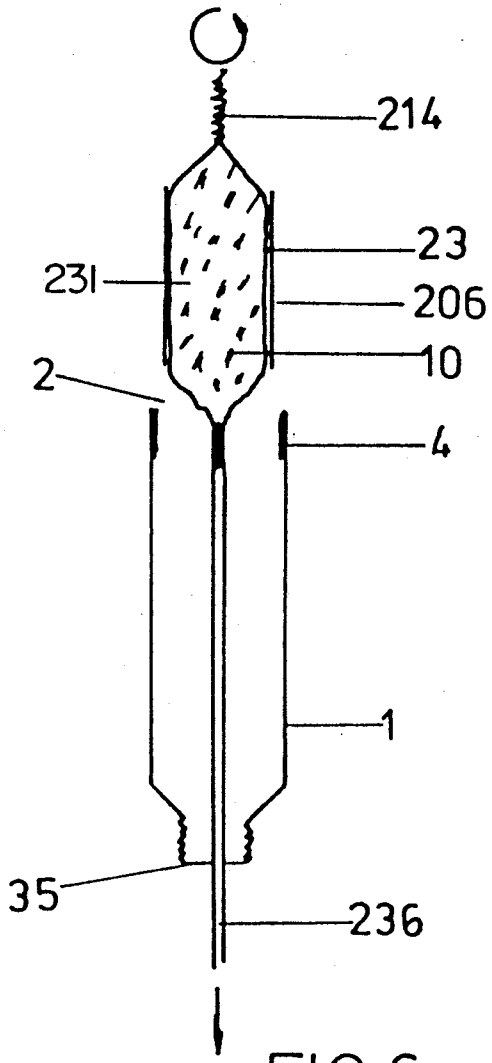
Figure 6B:
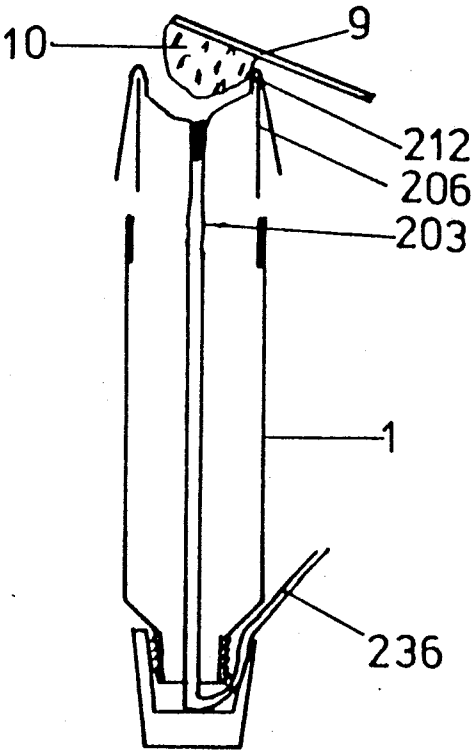
Figure 6A:
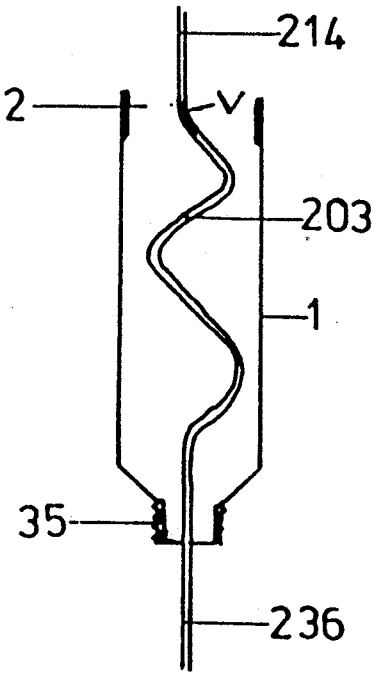
Figures 7A, 7B, 7C, 7D:
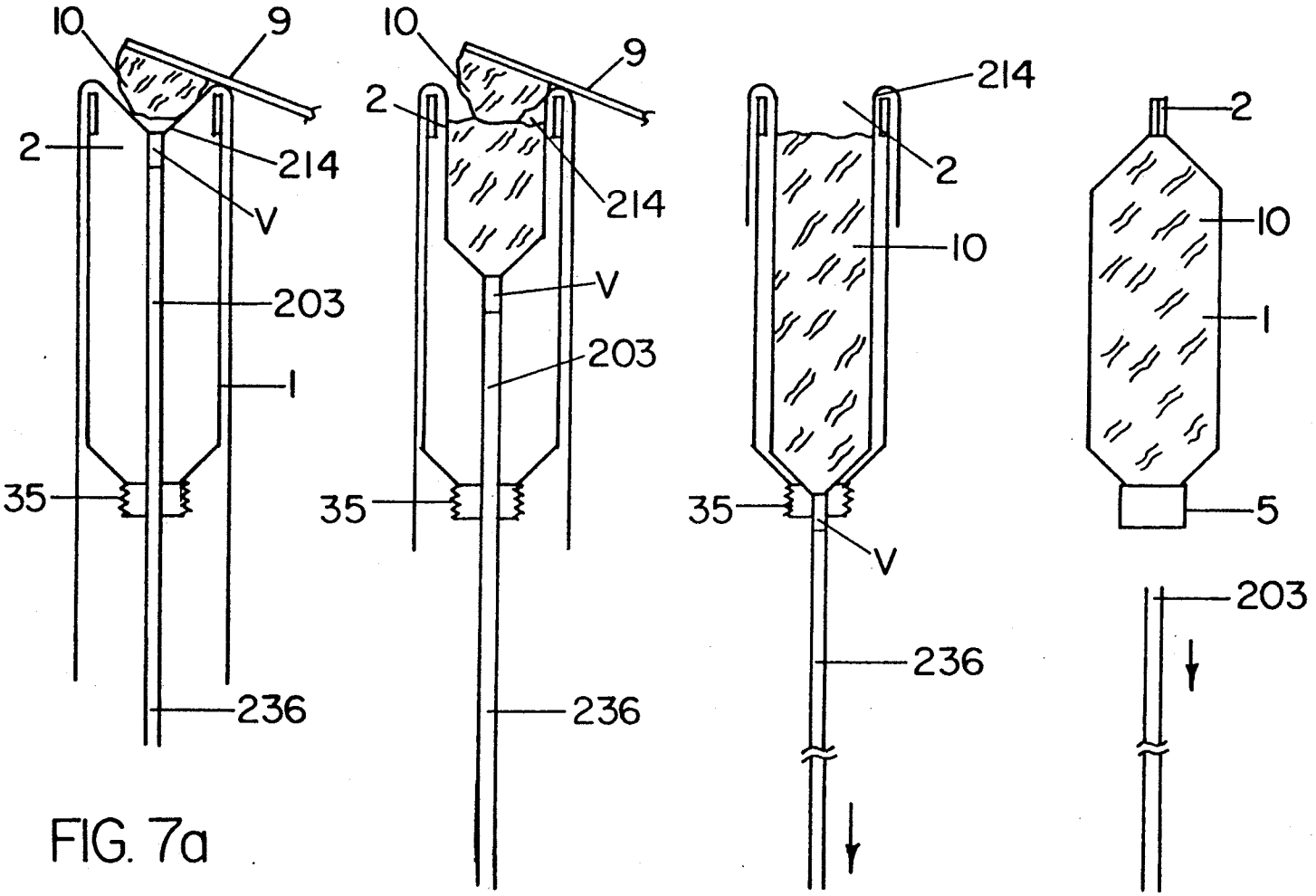

FIGS. 5*a*–5*c* show the sequence of operations of the method with a further arrangement for the filling of a tube, where the plastic skirt is introduced into the tube together with the filling material FIGS. 6*a*–6*c* show the sequence of operations of the method with a fourth arrangement for the filling of a tube, where the plastic skirt is passed through the tube before the filling, a part of the skirt lying outside the tube being then filled and subsequently drawn into the tube.

FIGS. 7*a* through 7*d* show the pulling of a plastic skirt through the tube to gradually fill the tube.

FIG. 1 shows a tube 1 with a thin plastic skirt 3 fixed to the as yet open bottom end 2 of the tube The tube 1 is provided with a latex ring 4 on the inside of its end 2, the said ring consisting of a kind of latex mass so designed as to be self-adhesive, so that when the tube is closed by pressing together the end 2, the adhesive bond comes to form an additional seal. Only latex mass adheres to the latex mass of the latex ring 4, but not—for example—smooth plastic material. The other end of the tube 1 can be closed by means of a closure cap 5, which consists of an ordinary screw cap. For handling the tube 1 and the plastic skirt 3 there is provided a piece of tubing 6, at one end of which there are the diametrically opposite finger cutouts 7 that permit the tube 1 to be gripped with the fingers and pulled out of the tubing 6. The internal diameter of the tubing 6 is so chosen as to permit the tube 1, complete with the plastic skirt 3 into which it is inserted, to be introduced into the tubing 6 in such a way as to be clamped and yet capable of being displaced.

As compared with the tube 1 with its closure cap 5, the tubing 6 is so designed as to be somewhat longer (by about 5 cm, for example), while the plastic skirt 3 is about twice as long. These dimensions derive from the following considerations:

The section of the plastic skirt 3 that is drawn over the latex ring 4 is determined by the greater length of the tubing 6 as compared with the tube 1. Given a 30 g tube, the latex ring 4 may have a width of about 1.5 cm. The inside of the tube end should therefore be kept free of ointment over a distance of about 3–4 cm. Approximately twice this length of the plastic skirt 3 should be reserved for being turned inside. This is obtained by dimensioning the tubing 6 so as to be about 5 cm longer. Furthermore, a length of the plastic skirt 3 corresponding to the filling length of the tube must be reserved for filling with the pasty mass and the end of the plastic skirt must project beyond the pasty mass after it has been filled into the skirt, so that the plastic skirt as a whole must be about twice as long as the complete tube. Given a 30 g tube having a length of 11.5 cm, about 23 cm will be needed for the plastic skirt 3, and the filling length within the tube will amount to about 6.5 cm. Given tubes with other filling lengths, the length of the plastic skirt will change accordingly.

The bottom-end opening 8 of the plastic skirt 3 has a slightly smaller circumference than the tube 1, while the remaining part of the plastic skirt is slightly larger. Due to elastic elongation and starting from the screw-cap end of the tube 1, the bottom-end 8 of the plastic skirt 3 can therefore be pulled over the end 2 of the tube 1 and there form a seating over a certain width (about 5–50 mm, preferably 25–35 mm) that will act as a seal and a clamp. The tube 1 is then inserted into the tubing 6 to the point where the closure cap 5 becomes aligned with the end of the tubing 6 where the finger cutouts 7 are provided. The part of the plastic skirt 3 projecting beyond the end of the tubing 6 is turned back (see FIG. 1*a*). The tube 1 is now pulled out of the tubing until the closure cap 5 comes to lie completely outside it. Using the closure cap 5, the tube 1 is then turned through about 10 half-turns with respect to the part of the plastic skirt 3 turned back over the tubing 6. This causes the film funnel to become twisted over a length of about 5–6 cm. This is the part of the plastic skirt provided for the protection of the latex ring 4 and must not therefore be moistened by the pasty mass.

At one and the same time, the twisting also serves as temporary closure or bottom of the plastic skirt 3, so that when pasty and, more particularly, low-viscosity masses (creams or emulsions, for example) are filled into the plastic skirt 3, the pasty mass will not partly flow into the tube 1, thereby forming air bubbles inside the tube 1, which would make complete filling of the tube difficult or impossible, and moistening the end 2. Rather than by twisting, this closure can also be obtained by means of a small clamp or clip (not shown in the figure).

Figure 1B:
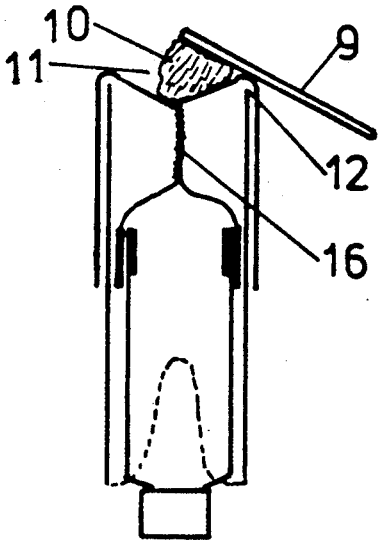
Figure 1C:
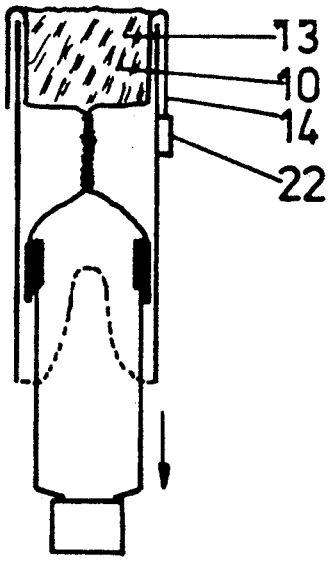

Using a spatula 9, a pasty mass 10 is then filled, portion by portion, into the top-end opening 11 of the plastic skirt 3, for which purpose the upper edge 12 of the tubing 6 serves as a firm stripping edge (see FIG. 1*b*). Pulling the tube 1 in the direction of the arrow also lengthens the part 13 of the plastic skirt 3 that accommodates the pasty mass, so that new space to contain further pasty mass is continually created. This is repeated until all the pasty mass 10 that is to be filled into the tube 1 is contained in the plastic skirt 3 (see FIG. 1*c*).

The part 14 of the plastic skirt end that remains turned back at this point is then slid off the upper edge 12, and the tubing 6, complete with the tube 1 and the filled plastic skirt 3, is turned through 180° and the upper edge 12 then placed on a firm, flat surface 15 and also on the end 14 of the plastic skirt. The plastic skirt end 14 thus prevents the pasty mass 10 from coming into contact with the surface 15, which may be—for example—a mixing table.

Figure 1D:
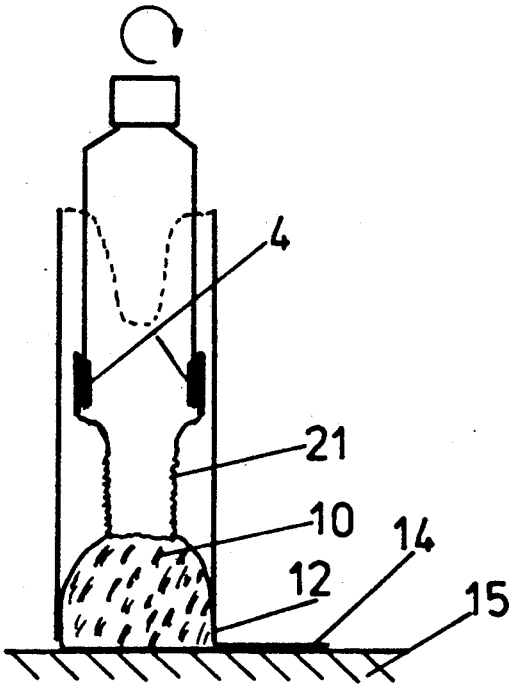
Figure 1E:
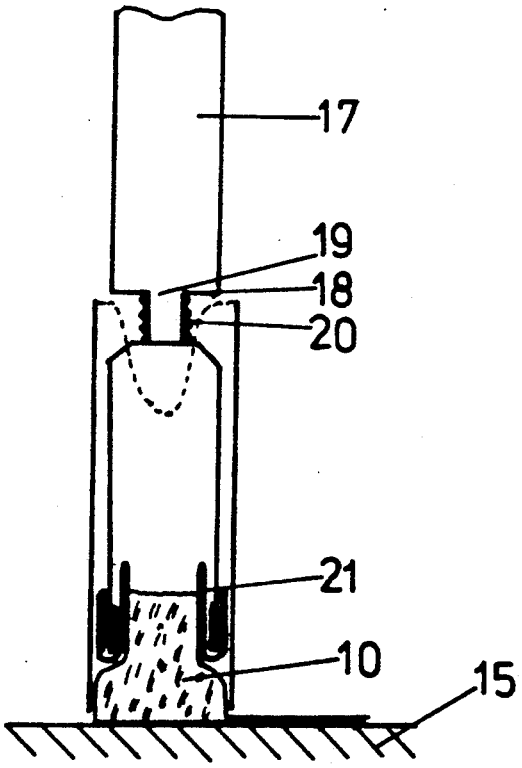

The twisting 16 is then undone by rotating the tube 1 through 10 half-turns in the opposite direction (FIG. 1*d*).

The closure cap 5 is then removed and, using a piston-like ram 17, the tube 1 is pressed downwards. The ram 17 has an end part 18 at the centre of which there is an opening 19, the said end part being smaller than the screw thread 20 of the tube 1. The tube 1 can also be pushed into the tubing 6 without a ram 17, i.e. by using the fingers through the finger cutouts 7. As the tube 1 is pressed into the tubing 6, the previously twisted section 21 of the plastic skirt 3 comes to be turned back protectively over the latex ring 4 and about 3–4 cm beyond it into the interior of the tube 1. The air contained in the interior of the tube can escape through the opening 19. With the help of the ram-piston 17 (FIG. 1*e*), the tube 1 is pushed downwards as far as the surface 15 and then lifted off the surface 15, after which the pasty mass 10 is pushed fully into the tube 1, again using the ram 17 (see FIG. 1*f*).

The tube 1 is then closed again, using the closure cap 5, and turned upside down. The end 2 with the latex ring 4 is pressed together and, pulling from the end 14, the plastic skirt 3 is then pulled out of the tube 1 through the constriction created in this manner. As this is done, the ointment residue adhering to the plastic skirt 3 will be squeezed completely into the tube 1. If the plastic skirt 3 is pulled out while the end 2 is pressed together (arrows), the latex ring will close by adhesion. The procedure does not cause the adhesive surfaces of the latex ring 4 to become moistened by the pasty mass.

The plastic skirt 3 can be pulled out of the tube 1 also without pressing the end 2 together, but in that case air will find its way between the plastic skirt 3 and the pasty mass 10. Just as in the traditional filling method, i.e. from the screw-cap end and using a press, the tube 1 can then be closed by pressing together the end 2. When this is done, however, one cannot always be sure that the pressing together of the end 2 will not cause a displacement of the pasty mass 10 within the tube that could yet bring it into contact with the latex ring 4.

In the method according to the present invention, however, one can exclude harmful wetting of the latex layer, because the turned back film funnel will come to lie protectively over the latex layer even during the pressing together of the end.

A modification of the method consists of introducing the pasty mass 10 into the tube not by pressure but by suction. When this is done, the pasty mass is introduced into the plastic skirt as described in FIGS. 1*a*–1*d* and, where appropriate, also 1*e*, but thereafter a vacuum is applied to the screw-cap opening of the tube by means of a flexible, slightly elastic and transparent plastic hose, which causes first the unwetted section 21 and then also the pasty mass 10 to be sucked into the interior of the tube. The suction process can be visually checked from the end 2 of the tube. Since only a slight underpressure (about 0.02–0.5 bar) is needed to suck the pasty mass into the interior of the tube, this underpressure can be preferably produced very simply and conveniently by means of a hand pump, but other pumps may also be used, a water jet blast pump being a case in point. Oral suction is also possible in case of private use only.

The tubing 6 is preferably made of a transparent material, acrylic glass for example, so that the twisting of the skirt end and the introduction of the pasty mass can be readily followed and controlled.

A further advantage of the method consists of the fact that the tubing 6 makes it possible to proportion the pasty mass, a medicinal ointment for example into doses. This can be done by placing the entire arrangement on a balance and weighing a content of, say, 30 g in the plastic skirt 3. If 30 g of ointment are now to be filled repeatedly into a tube, a marker 22 (see FIG. 1*c*) is stuck onto the transparent tubing 6 in such a position as to indicate during the filling of the tube that the content of pasty mass 10 has reached 30 g. Given the cylindrical form of the tubing 6, it can be used in the manner of a measuring flask, with the scale on the tubing running from the top to the bottom.

The method according to the present invention can therefore be used not only for making up prescriptions, i.e. the preparation and dispensing of a single medicament, 1×30 g of a medicinal ointment being a case in point, but also for the preparation of a larger number of packings of a medicament, for example 10×30 g of a certain medicinal ointment, in which case the doses may also be taken from a larger quantity, say, from a 1 kg or a 10 kg container of the ointment.

In principle, the method according to present invention does not call for the subsequent cleaning of any kind of equipment.

The fact that the tube is made to pass over the filled plastic skirt from above (see FIG. 1*e*) ensures that the filling mass penetrates into the tube from below, thus once again avoiding an uncontrolled flow into the tube—as previously discussed—with the danger of forming enclosed air bubbles.

The pasty mass 10 can also be filled into the tube without the tubing 6. To this end the spatula 9 is inserted in the plastic skirt 3, the skirt being then twisted through about 20 half-turns, after which the twisted part is pushed into the tube 1. Rather than being stripped from the spatula by the edge of the tubing 6, the pasty mass 10 is then stripped directly against the open edge of the tube and into the bottom-end opening 8. In this case the twisted part has to be long enough to ensure that the plastic skirt 3 can be slid into the tube 1 during the filling. The stripping of the pasty mass 10 from the spatula 9 has to be undertaken with due care to ensure that the plastic skirt 3 will not be damaged at the tube edge. Excessively sharp edges of the open end of the tube should therefore be avoided.

In a variant of the method, the plastic skirt 3 is not fixed to the outside of the end 2 of the tube 1 but, as illustrated in FIG. 2, to the inside of the tube. To this end one needs a piece of tubing 23 that accurately fits into the as yet open bottom end 2 of the tube 1 and holds the plastic skirt 3 against the inside of the tube. It is advantageous for the tubing 23 used for this purpose to be made of a slightly elastic material.

Figures 2A, 2B, 2C, 2D:
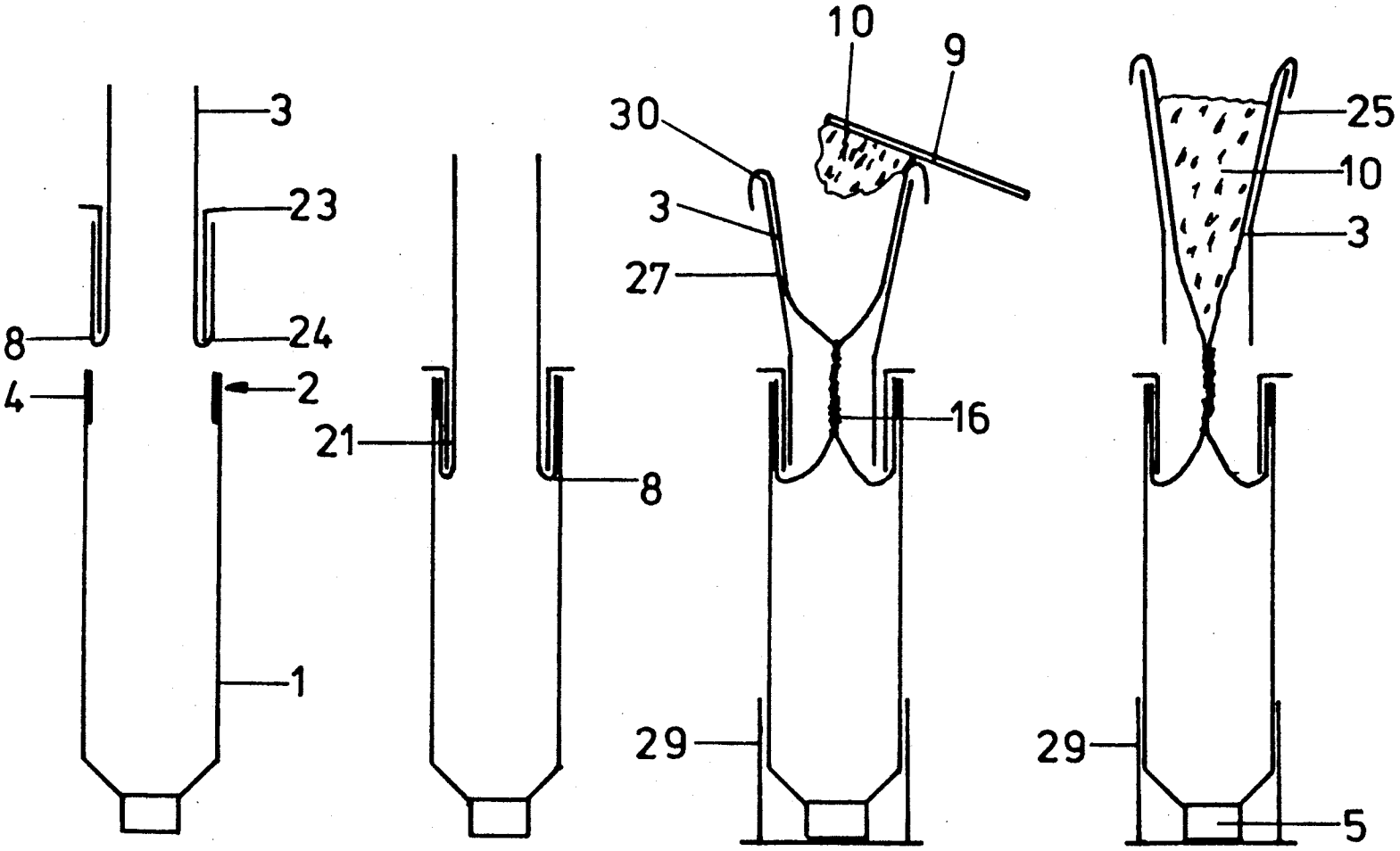

When the tubing 23 is intended for repeated use, the plastic skirt 3, which should be designed as previously described, though it may be a little shorter, is pulled through the tubing 23 and turned back over an opening 24 that is to be introduced into the end 2 of the tube 1 (FIG. 2*a*). The opening 24 is inserted into the end 2 and fixed there by means of, for example, clamping or screwing. The pressure of the tubing 23 keeps the plastic skirt 3 in close contact with the inner wall of the tube (FIG. 2*b*). As previously described, the pasty mass 10 can be filled into the tube by means of a spatula either with or without a piece of tubing 6 that can be slid through the as yet open bottom end 2 of the tube, or also by means of a filling funnel 25 as shown in FIG. 4. The filling funnel 25 has a lower section 26 that is essentially cylindrical in shape and can be slid into the tubing 23. An upper section 27 of the filling funnel 25 is designed in the manner of a funnel. A slit 28 runs along the entire length of the filling funnel 25 and permits the plastic skirt 3 to be laid into the filling funnel.

As shown in FIG. 2*c*, the tube 1 is placed into a stand 29, the plastic skirt 3 is inserted into the filling funnel 25 and turned back over its upper edge 30. The filling funnel 25 with the plastic skirt 3 is rotated through about 4 half-turns with respect to the tube 1 and the tubing 23 that keeps the bottom end opening 8 of the plastic skirt 3 in position, thus producing a twisted part 16. A small number of turns is quite sufficient to produce this twisting 16, because the twisted section does not have to cover the latex ring 4. This is already done by the tubing 23 and/or the lower part 21 of the plastic skirt 3 that has been inserted by means of the tubing 23. The pasty mass is filled into the plastic skirt 3 by means of the spatula 9, the upper edge 30 of the filling funnel 25 serving as the stripping edge.

Either during the filling of the pasty mass 10 or after the pasty mass 10 has been filled into the plastic skirt 3, the filling funnel 25 is lifted and slightly compressed, thereby causing the part of the plastic skirt 3 filled with the pasty mass 10 to assume the shape of a sausage (FIG. 2*d*).

Figure 2G:
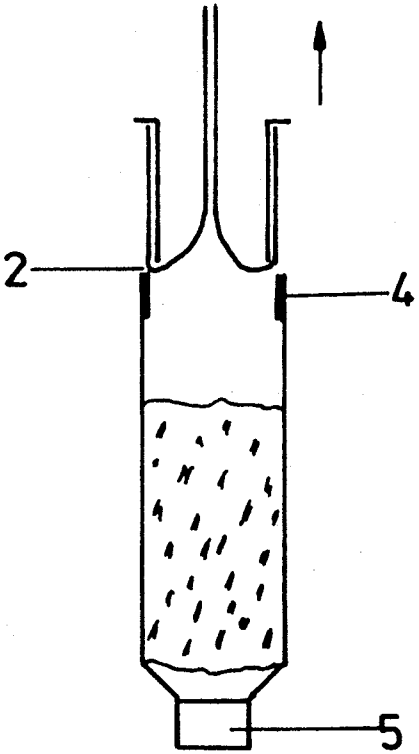
Figure 2F:
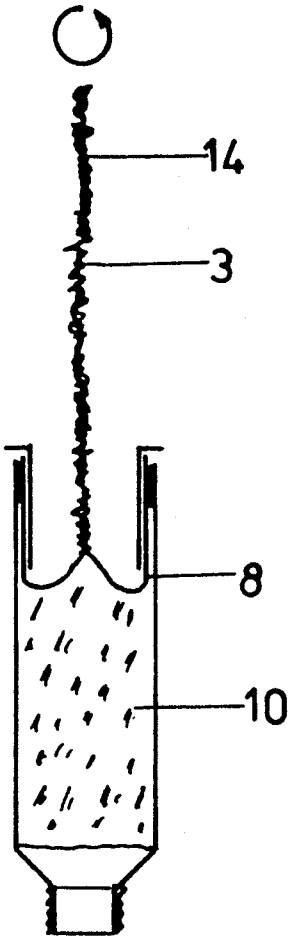
Figure 2E:
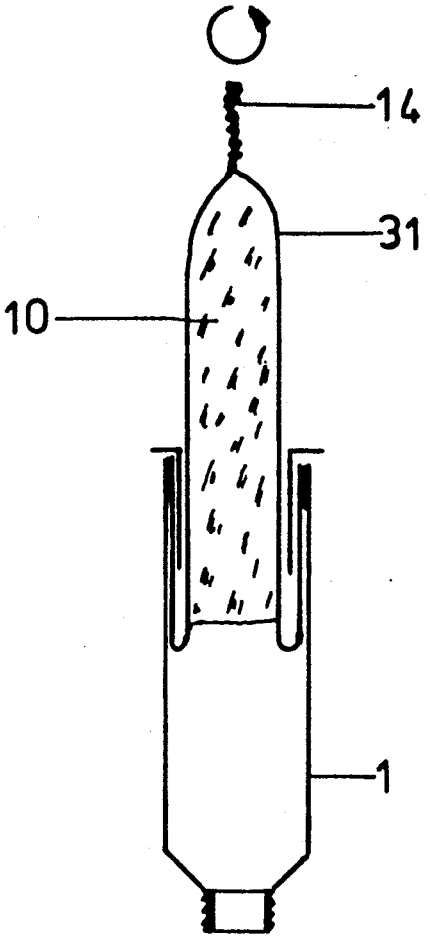

This sausage-shaped part 31 is pushed through the tubing 23 into the tube 1, for which purpose the tube 1 is first removed from the stand 29, the plastic skirt 3 is untwisted and the closure cap 5 removed. With a view to permitting complete transfer of the pasty mass 10 into the tube 1, the end 14 of the plastic skirt is closed by twisting (FIG. 2*e*). As twisting continues, the plastic skirt 3 is emptied right down to its bottom-end opening 8 (FIG. 2*f*). While this is being done, the tube can be held by the part of the tubing 23 that projects from the tube.

Thereafter the closure cap 5 is screwed back onto the tube 1 and the piece of tubing 23 detached from the tube 1 by rotation. This causes the film to lift off the filled material. One is therefore left with the filled tube 1, whose latex coating is not moistened by the filled material (FIG. 2*g*). The tube 1 can then be closed—just like the tube filled in the traditional manner—by pressing the latex ring together and, where appropriate, folding back the end 2.

FIG. 3 illustrates possible embodiments of the tubing 23. In FIG. 3*a*, for example, the tubing 23 has a flanged edge 32, which will bear against the end 2 of the tube when the tubing is inserted. Holding of the tubing 23 in the tube is ensured by a short threaded section 33. This threaded part 33 can be readily screwed into the thin tube material, generally aluminium. Any latex layer that may be present will not be damaged when this is done.

FIG. 3*b* shows a conically tapering piece of tubing 123, where the outer diameter of the upper part 132 is larger than the inner diameter of the tube. The plastic skirt 3 is simply clamped into the tube by means of this cone-shaped tubing.

FIG. 3*c* shows a piece of tubing 23 intended to be used once only, where the tubing itself may be designed either as in FIG. 3*a* or FIG. 3*b*. In this embodiment the tubing is preferably made of plastic material, with the plastic skirt 3 preferably already attached to the lower edge by clamping or welding. This embodiment is particularly convenient in use, because the person filling the tube does not have to pull the plastic skirt 3 into the tubing 23 or to clamp the plastic skirt in the interior of the tube 1.

This procedure permits the filling of the pasty mass 10 into the plastic skirt 3 to be performed on a balance, so that a given quantity of pasty mass 10 can be readily determined by weighing and then transferred practically completely into the tube. Following use, the tubing 23 can be deposited in the stand 29 and the filling funnel 25 placed on top of it, so that all parts are always readily to hand. In this case, once again, no special work station is needed for filling the tube.

FIG. 5 illustrates further possibilities of introducing a pasty mass 10 into a tube 1. The principle in this case is that the pasty mass 10 is filled into an essentially hose-shaped plastic skirt 103, both ends of which are closed when the pasty mass 10 with the plastic skirt 103 is introduced into the tube 1. The filling of the hose-shaped plastic skirt 103 can be performed as already described in FIGS. 1*a*–1*c*, the end 114 of the plastic skirt being then closed by twisting. The starting point may also be a hose-shaped plastic bag (not shown in the figure) that can be filled with the help of a piece of tubing 6 as previously described.

The plastic skirt 103 is preferably filled within a flexible piece of tubing 106, the end 114 being subsequently closed by twisting (FIG. 5*a*). Once the plastic skirt 103 has been closed, pressure (arrows) is exerted on the flexible tubing in order to reduce the diameter of the filled plastic skirt (FIG. 5*b*), so that the sausage-shaped section 131 of the plastic skirt 103 thereby produced can be easily introduced into the tube 1. To this end the bottom-end opening 108 can be either removed from the twisting by cutting or melting or, alternately, the tubing 23 can be turned upside down, so that the twisted end 114 of the plastic skirt becomes the first to be introduced into the tube 1. If necessary, the twisted end 114 of the plastic skirt can also be shortened (FIG. 5*c*).

Transfer of the pasty mass 10 with the plastic skirt 103 is obtained simply by placing the tubing 106 onto the as yet open end 2 of the tube 1, so that gravity will cause the plastic skirt 103 with the pasty mass 10 to drop into the interior of the tube.

The closure cap 5 must be removed when this is done, so that—as shown in FIG. 5*c*—the twisted end 114 of the plastic skirt can slide through the screw-cap opening 35 of the tube 1. This end 114 of the plastic skirt, which projects through the screw-cap opening 35, can be cut off either immediately after filling or when the tube is first used. The tube 1 is closed at its end 2 by pressing together the latex ring as previously described. The pasty mass 10 remains in the plastic skirt 103 and is squeezed out through the end 114 thereof.

FIG. 6 illustrates yet another possible way of filling a pasty mass 10 into a tube 1, which makes use of a long, hose-shaped plastic skirt 203 with a leading end 236 that projects through the screw-cap opening 35 of the tube 1 already before filling is commenced and which, preferably, is already packed and dispatched in this position by the tube manufacturer (FIG. 6*a*). In that case the plastic skirt 203 can be sterilized and closed at both ends, thus ensuring completely sterile filling and making it impossible for the interior space to become fouled during the transport of the empty tube 1. In order to avoid the plastic skirt 203 being accidentally pulled out of the tube during the handling thereof, the leading end 236 of the plastic skirt 203 is held in position by means of the closure cap 5 before filling is commenced. The trailing end 214 of the plastic skirt is pulled out of the bottom end 2 of the tube 1 opened and through a short piece of tubing 206, subsequently being turned back over the upper edge 212 of that tubing. The hose-shaped plastic skirt 203 will thus open in the interior of the short piece of tubing 206 over a distance of several cm, and the pasty mass 10 can then be filled into this space by means of a spatula 9 as previously described (FIG. 6*b*). Once the pasty mass 10 has been filled into the hose-shaped plastic skirt 203, the end 214 of the skirt is closed, by twisting or melting for example. By pulling from the leading end 236 (FIG. 6*c*), the section 231 of the hose-shaped plastic skirt 203 filled with the pasty mass 10 is then brought into the interior of the tube 1 and the leading end 236 can be shortened back to the tube. This shortening can be obtained by cutting off or melting away. When melting is used, the pasty mass 10 will remain hermetically closed and the molten part of the hose-shaped plastic skirt 203 can then be cut away before the pasty mass is squeezed out of the tube for the first time. The end 2 of the tube can be closed as previously described.

The plastic skirt 203 may also be provided with a V-stopper, which can be obtained—for example—by means of welding during the manufacture of the skirt. This V-stopper performs the same function as a closure by twisting. The projecting end 236 is cut off after the filling of the tube, preferably before the V-stopper.

Also, the piece of tubing 206 can be omitted and the pasty mass 10 stripped from the spatula 9 into the plastic skirt 203 by means of the as yet open edge of the tube, the skirt having first been turned back over the bottom-end opening 8 of the tube 1. By pulling from the leading end 236, the pasty mass 10 is pulled gradually into the tube 1 as filling proceeds. See FIGS. 7*a* through 7*d*.

The methods and/or apparatus described in FIGS. 5 and 6 have the advantage that practically the entire tube is protected by the plastic skirt against coming into contact with the pasty mass. Only a small part of the screw-cap opening 35 can still be moistened by the pasty mass. The previously customary contact between the pasty mass and the tube constitutes a certain problem during the manufacture of the tube that has hitherto been countered by lacquering the interior of the tube, so that any aggressive substances present in the pasty mass, salicylic acid being a case in point, cannot attack the tube material, generally aluminium, by means of a chemical reaction.

In the methods according to FIGS. 5 and 6 as described hereinabove, however, protection is afforded by the plastic skirt, so that relatively cheap tubes without internal lacquering may also be used, possibly also with a plastic thread 20. The use of the film funnel therefore has feedback effects and will make possible cost savings during tube manufacture. A further advantage of this method derives from the fact that no waste is produced during tube filling, because the plastic skirt remains in the tube.

A modification of the method according to FIGS. 5 and 6 is possible inasmuch as the plastic skirt can also be removed from the tube, leaving only the pasty mass. To this end the plastic skirt is introduced into the tube with an open bottom-end opening 108 or an open end 214 of the plastic skirt, the screw-cap opening 35 being then reduced in size—by exerting finger pressure on the screw-cap opening for example—in such a manner that the plastic skirt can be drawn out through this screw-cap opening, while the pasty mass will be retained. A colour marking on the plastic skirt can be used to indicate its end, so that the size reduction of the screw-cap opening 35 can be terminated, thereby avoiding the screw cap coming into contact with the pasty mass.

The described methods and apparatus have yet other advantages:

According to the present invention, a maximum of about 500 mg of pasty mass remain sticking to the plastic skirt and will not therefore be available when the tube is used. In customary filling equipment, on the other hand, about 2.7 g will remain behind, so that the filling of a 10 g tube will call for an extra 27% of filling material and this excess must subsequently be removed with the help of solvents and detergents and discharged to waste. It is a further advantage that the plastic skirt prevents the accumulation of dust in the interior of the tube, i.e. that the pasty mass (as shown in FIGS. 5 and 6) can be filled into a completely clean and sterile container.

Dust accumulation in the tube interior during transport to the place of filling constitutes an as yet unsolved problem in the manual filling of tubes. According to the invention, however, the plastic skirt can be pulled over the end of the tube immediately after the manufacture of the tube, where the skirt may also be applied by shrinking on, the plastic skirt is then closed, or—better still—remains closed while it is being pulled on, so that the tube interior remains protected against the intrusion of any foreign matter until the filling process is commenced.

The methods and apparatus according to the present invention make it possible for the tube to be filled from its end no matter what kind of tube is used, including tubes that are not provided with a latex ring or similar closure aids. Since most of the tubes at present in commerce have standard diameters and the different tube sizes are distinguished by only a small number of different diameters, only 3 or 4 different-sized sets of aids and plastic skirts will be needed to put the user in condition to fill practically all the tubes at present in commerce.

The plastic skirt 3, 103, 203 can also be provided with markings (rings, for example) during manufacture that will then make it possible for the filling material to be dosed to within an accuracy of about 10%. Such dosing accuracy is permissible when the tubes are filled from a larger stock.

All the drawings are in schematic form to facilitate proper understanding. The distances between the plastic skirt, the tube, the tubing and the other aids are shown greater than they are in actual practice, this in order to clearly illustrate the alignment of the plastic skirt. If the methods are to function perfectly, however, the plastic skirt, the tube and tubing should be kept as close together as possible. A suitable material for the plastic skirt is a thin, inert plastic material that should also be reasonably elastic. Examples of such materials are polypropylene film, polyethylene film and, preferably, low-pressure polyethylene film, all of which are stable and yet elastic.

All the methods and devices according to the present invention are distinguished by the common feature that the interior of the as yet open bottom end of the tube is protected by a thin plastic film that prevents it from coming into contact with the pasty mass that is to be filled into the tube. The pasty mass, passing through this thin plastic film, is conveyed into a part of the tube interior that is at some distance from the end of the tube to be closed, the plastic film being removed again when the end is actually closed. This removal of the plastic film can be obtained, for example, by transferring the film—together with the pasty mass—into the tube interior, or by pulling the thin plastic film out of the tube end. Depending on the type of tube and the closure mechanism, the thin plastic film or a part thereof may also remain at the tube end during closure, but care must be taken to ensure that no residue of the pasty mass filled into the tube can issue from this plastic film during the closure of the bottom end, or at any time thereafter, to find its way to the bottom end of the tube.

I claim:

1. A method of placing a pasty mass into a tube through an open bottom end of the tube, said bottom end having an edge, said tube also having a neck opening, said tube including a substantially hose-shaped flexible plastic skirt having a leading end and a trailing end, said plastic skirt being disposed in the tube so that said leading end is projecting through said neck opening and said trailing end is projecting through said bottom end, said method comprising:

turning back said projecting part of said trailing end over said bottom end;

repeatedly placing a portion of said pasty mass into said trailing end of said plastic skirt;

pulling the plastic skirt from the leading end after each portion of said pasty mass has been placed in said plastic skirt to thereby gradually pull said pasty mass into said tube;

inserting said trailing end of said skirt into the tube by pulling said leading end when a desired amount of pasty mass is placed in the tube;

shortening the leading end so that it does not extend outside of said neck opening; and closing the bottom end of said tube.

2. The method of claim 1, wherein said turned back part of said trailing end and said bottom end form a stripping edge, and wherein said placing step includes:

stripping at said stripping edge a portion of said pasty mass from a filling implement by rubbing the implement on said stripping edge.

3. The method of claim 1, further comprising:

welding a stopper to said skirt between said leading end and said trailing end to close an end of said skirt.

4. A method of placing a pasty mass into a tube through an open bottom end of the tube, said bottom end having an edge, said tube also having a neck opening, said tube including a substantially hose-shaped flexible plastic skirt having a leading end and a trailing end, said plastic skirt being disposed in the tube so that said leading end is projecting through said neck opening and said trailing end is projecting though said bottom end, said method comprising:

turning back said projecting part of said trailing end over said bottom end;

placing a pasty mass into said trailing end of said plastic skirt;

pulling the plastic skirt from the leading end after a portion of said pasty mass has been placed in said trailing end to thereby gradually pull said pasty mass into said tube;

inserting said trailing end of said skirt into the tube by pulling said leading end when a desired amount of pasty mass has bene placed in the tube;

removing said skirt from said tube by continued pulling said leading end through said neck opening; and closing the bottom end of said tube.

5. The method of claim 4, wherein said turned back part of said trailing end and said bottom end of said tube form a stripping edge, and wherein said placing step includes:

stripping at said stripping edge a portion of said pasty mass from a filling implement by rubbing the implement on said stripping edge.

6. The method of claim 4, further comprising:

exerting pressure on said neck opening while removing said skirt.

7. The method of claim 4, further comprising:

welding a stopper to said skirt between said leading end and said trailing end to close an end of said skirt.

8. A method of placing a pasty mass into a first tube through an open bottom end of the first tube, said first tube also having a neck opening, comprising:

placing a leading end of a flexible plastic skirt over the bottom end of said first tube, said skirt also having an opposite trailing end;

placing a front end of a second tube over said leading end of said skirt, said second tube also having a back end;

turning back at least a portion of said trailing end over said back end;

placing a pasty mass into said plastic skirt; covering said pasty mass with said trailing end of said skirt;

pressing the back end of said second tube onto a firm surface to push said skirt containing said pasty mass into said bottom end of said first tube;

applying a force to said skirt containing said pasty mass; and closing said bottom end.

9. The method of claim 8, wherein said turned back portion of said trailing end and said back end of said second tube form a stripping edge, and wherein said placing a pasty mass step includes:

stripping at said stripping edge a portion of said pasty mass from a filling implement by rubbing the implement on said stripping edge.

10. The method of claim 8, further comprising:

removing at least a portion of said skirt from said bottom end before closing said bottom end.

11. A method of placing a pasty mass into a first tube through an open bottom end of the first tube, said first tube also having a neck opening, comprising:

placing a leading end of a flexible plastic skirt over the bottom end of said first tube, said skirt also having a trailing end;

placing a second tube over the trailing end of said skirt, said second tube having a front end and a back end;

turning back at least a portion of said trailing end of said skirt over said back end of said second tube;

placing a pasty mass into the trailing end of said skirt; covering said pasty mass with said trailing end of said skirt;

sliding the front end of said second tube over the leading end of said skirt;

applying a force to said trailing end of said skirt to push said pasty mass into the bottom end of said first tube; and closing the bottom end of said first tube.

12. The method of claim 11, wherein said turned back portion of said trailing end and said back end of said second tube form a stripping edge, and wherein said placing a pasty mass step includes:

stripping at said stripping edge a portion of said pasty mass from a filling implement by rubbing the implement on said stripping edge.

* * * * *

UNITED STATES PATENT AND TRADEMARK OFFICE

CERTIFICATE OF CORRECTION

PATENT NO. : 5,212,931

DATED : May 25, 1993

INVENTOR(S) : Heinz Hartmann

It is certified that error appears in the above-identified patent and that said Letters Patent is hereby corrected as shown below:

CLAIM 4, Col. 10, Line 56, delete "though" and substitute therefor ---through---; CLAIM 4, Col. 10, Line 63, delete "in" and substitute therefor ---into---; CLAIM 4, Col. 10, Line 68, delete "bene" and substitute therefor ---been---.

Signed and Sealed this

Eleventh Day of January, 1994

Bruce Lehman

*Attest:*

BRUCE LEHMAN

*Attesting Officer*

*Commissioner of Patents and Trademarks*